United States Patent [19]

Seiler

[11] Patent Number: 5,002,099

[45] Date of Patent: Mar. 26, 1991

[54] HOOK CONTROL APPARATUS FOR A SHED FORMING JACQUARD MACHINE

[75] Inventor: Wolfgang Seiler, Monchen-Gladbach, Fed. Rep. of Germany

[73] Assignee: Fa. Oskar Schleicher, Monchen-Gladbach, Fed. Rep. of Germany

[21] Appl. No.: 468,632

[22] Filed: Jan. 22, 1990

[30] Foreign Application Priority Data

Jan. 31, 1989 [DE] Fed. Rep. of Germany ..... 3902792

[51] Int. Cl.[5] ..... D03C 3/06; D03C 13/00

[52] U.S. Cl. ..... 139/455; 139/65

[58] Field of Search ..... 139/65, 455, 59

[56] References Cited

U.S. PATENT DOCUMENTS

| | | | |
|---|---|---|---|
| 4,530,382 | 7/1985 | Schleicher | 139/59 X |
| 4,690,178 | 9/1987 | Basu et al. | 139/455 |
| 4,739,806 | 4/1988 | Palau et al. | 139/455 |

FOREIGN PATENT DOCUMENTS

| | | |
|---|---|---|
| 0173135 | 9/1985 | Japan . |
| 3249735 | 10/1988 | Japan . |

*Primary Examiner*—Andrew M. Falik

*Attorney, Agent, or Firm*—Mason, Kolehmainen, Rathburn & Wyss

[57] ABSTRACT

A hook control apparatus for a shed forming machine comprises lift blades for lifting the hooks which are adapted to pivot in a bottom shed position between a hooking position and a non-hooking position relative to the blades. The hooks are supported in the bottom shed position on a hook bottom member and are biased towards their hooking position. The apparatus further includes one or more electromagnets for arresting the hooks in their non-hooking position relative to the blades. The electromagnets are arranged on the other side of points of reversal of the movement of the lift blades, which are remote from the respective hooks. A respective elongate control member is disposed movably in the direction of movement of the lift blades between each of the electromagnets and hooks. The end portion of each control member which is towards a respective electromagnet is in the form of an armature while provided at the opposite end portion of each control member is a mechanical arrester co-operable with the respective hook to retain it in the non-hooking position thereof.

5 Claims, 1 Drawing Sheet

HOOK CONTROL APPARATUS FOR A SHED FORMING JACQUARD MACHINE

BACKGROUND OF THE INVENTION

The present invention concerns a hook control apparatus for a shed forming machine such as a Jacquard machine.

One form of hook control apparatus for a shed forming machine, as disclosed in German patent specification No. 3 713 832, comprises lift blades and hooks which can be selectively entrained by the lift blades. The hooks are adapted to pivot in a bottom shed position between a hooking engagement position in which they can be engaged by the blades and a non-hooking position in which they are not engageable by the blades. The hooks are supported in the bottom shed position on a hook bottom member and are biased towards the hooking engagement position. The hooks can be arrested and retained in their non-hooking position by suitable magnetic means such as electromagnetic devices. In that arrangement therefore the magnetic means are disposed in the region of the pivotal movement of the hooks at the level of the bottom shed position thereof, and the hooks are in the form of magnet armature members. However, a disadvantage with that design configuration is that the magnetic means are disposed at locations which do not afford ready access thereto. The electric leads required for electrical actuation of the magnetic means each have to be brought out of the region of the bottom shed position and the region of the lift blades respectively. The amount of space available for installation of the magnetic means in the arrangement is very small, unless the disadvantage of the machine being of very substantial depth can be tolerated. Further problems with that arrangement arise out of the consideration that the magnetic force for actuation of the hooks is required to be sufficiently high while on the other hand the magnetic leakage of the magnetic means needs to be at a low level.

In the above-indicated arrangement in which the hooks constitute magnet armature members, each hook consists entirely of iron for use as the armature member. As the lift blades generally comprise steel, it is necessary to provide lubrication at the respective point of contact between each hook and the co-operating lift blade, which can be a further disadvantage in such a machine. If however use is made of another possible way of providing the armature member, in which each hook for example comprises a plastic material and the armature member is in the form of an iron member which is incorporated into the plastic hook as by being included in the injection molding forming the latter, then that design configuration is expensive to manufacture. Further problems arise due to the differences in the coefficients of thermal expansion of the plastic and ferrous materials used, which can have a disadvantageous effect in regard to the flatness or straightness of the contact surfaces on the armature members, which are intended to come to bear against the respective electromagnetic means. It will be appreciated that, if the armature members do not lie in full flat surface contact against the magnetic means, the armature member retaining force is considerably reduced, with the result of a reduction in operating reliability of the system. Distortion caused by differences in thermal expansion of the plastic hook and the iron armature member may prevent full flat surface contact between the respective armature member and the co-operating magnetic device.

SUMMARY OF THE INVENTION

An object of the present invention is to provide a hook control apparatus for a shed forming arrangement, which does not suffer substantially from the above-mentioned disadvantages.

Another object of the present invention is to provide a hook control apparatus for a shed forming arrangement, which includes magnetic operating means which are disposed at readily accessible locations without having an adverse affect on the size of the arrangement, while retaining the advantages of hook members which are adapted to be controlled between different operating positions in a bottom shed position.

Still another object of the present invention is to provide a hook control apparatus for a shed forming arrangement, which can give improved control by means of electromagnetically operated devices.

Yet a further object of the invention is to provide a hook control apparatus in a shed forming arrangement, in which the hooks can be designed and arranged without having regard to functioning thereof as magnet armature means.

In accordance with the principles of the present invention, those and other objects are achieved by a hook control apparatus for a shed forming machine such as a Jacquard machine, comprising lift blades, and a plurality of hooks which are adapted to pivot in a bottom shed position between a hooking position in which they are adapted to be engaged by the blades and a non-hooking position in which they are not engageable by the blades. The hooks are supported in the bottom shed position on a hook bottom member, and are biased towards the hooking engagement position. Magnet means such as electromagnetic means are operable to retain the hooks in their non-hooking position. The magnet means are arranged at the side of the point of reversal of movement of the respective lifting blade, which is remote from the hook. Disposed between each magnet means and the associated hook is a respective elongate control member which is adapted to be movable in the direction of movement of the lift blades. The control member has a first end portion which is towards the respective magnet means and is in the form of a magnet armature, and a second end portion which is towards the respective hook and which provides a mechanical arresting means for engaging a co-operating portion on the hook, thereby to retain the hook in the non-hooking position.

An advantageous feature of the invention provides that the arresting means is in the form of a tapering projection on the control member while the co-operating portion on the hook is of a configuration adapted to co-operate with the projection on the control member, in such a way that the projection and the co-operating portion on the hook can co-operate by means of positive interengagement.

In another preferred feature of the invention, the projection on the control member and the co-operating portion on the hook each comprise a recess portion and a raised portion. The recess portions and the raised portions on respective projections on the control members and the co-operating portions on the respective hooks are advantageously of a rounded configuration, blending into each other in a smooth wave-like fashion. As the hook performs a pivotal movement and the control member performs a linear movement, when the arresting means comes into co-operating contact with the co-operating portion on the hook, the result is a complicated sequence of movements which involve gentle sliding actions as between the co-operating components, by virtue of the rounded and smoothly blended configurations referred to above.

In another preferred feature of the invention, the control member is subjected to a biasing force which is operative in the longitudinal direction thereof. The biasing force may be produced for example by a biasing spring which is operative in the longitudinal direction of the respective control member towards the associated magnet means, in which case the biasing force of the spring is less than the pivoting biasing force which acts on the corresponding hook; thus, when the magnet means is not actuated, the pivoting biasing force acting on the hook provides that the hook overcomes the spring biasing force acting on the control member and the hook is released from the arresting position relative to the control member and can thus pivot into the hooking engagement position in which it can be engaged by the lift blade.

Further objects, features and advantages of the present invention will be apparent from the following description of a preferred embodiment.

DESCRIPTION OF THE PREFERRED EMBODIMENT

Figure 1:
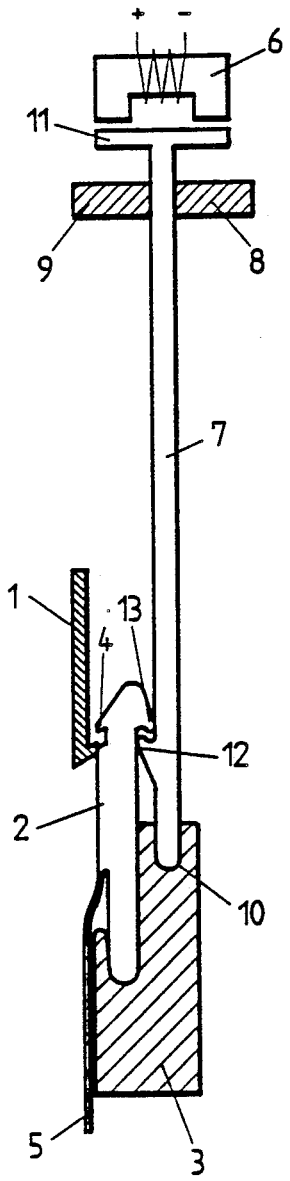
FIG. 1 is a diagrammatic view of a hook control apparatus with shed forming elements.
Figure 2:
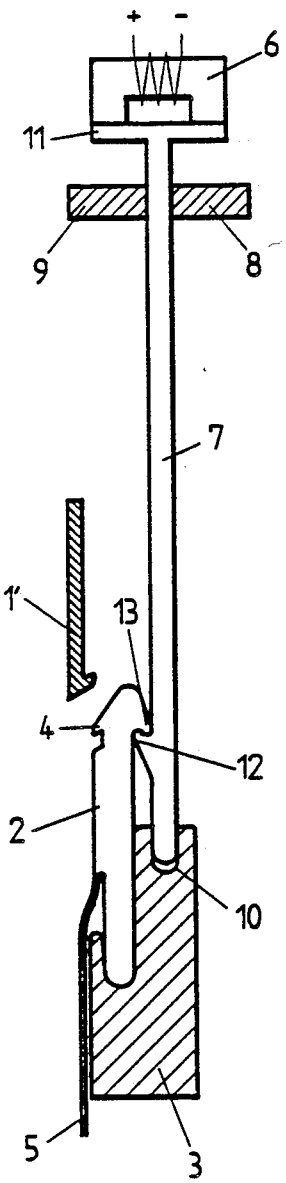
FIG. 2 is a view of the FIG. 1 structure in another position thereof.

Referring to the drawings, reference numeral 1 therein denotes a lift blade which is adapted to be moved up and down by a suitable drive arrangement (not shown). FIG. 1 shows the lift blade in the position in which it is at the bottom dead center point in respect of its lift movement, FIG. 2 shows the lift blade in an intermediate position as indicated at 1' while FIG. 3 shows the lift blade in the position in which it is at the top dead center point of its lift movement, as indicated at 1".

Reference numeral 2 in the drawing denotes a hook of the arrangement. The hook 2 is shown in the bottom shed position and is supported on a hook bottom member indicated by reference numeral 3. In the usual fashion, at its side which is towards the lift blade 1, the hook 2 has a hooking portion 4 which is intended to engage with the blade 1, in a manner which will be clearly apparent from the drawing (see in particular FIG. 1). The hook 2 is pivotable on the hook bottom member 3 between a non-hooking position as shown in FIGS. 1 and 2, in which it cannot be engaged by the lift blade 1, and a hooking engagement position as shown in FIG. 3 in which the hook can be appropriately engaged by the blade 1. The hooking engagement position of the hook is indicated at 2' in FIG. 3. In the illustrated embodiment, the hook is biased into the hooking engagement position 2' in which it has been pivoted in a counterclockwise direction relative to the non-hooking position 2 shown in FIGS. 1 and 2, by the action of a pulling harness system as diagrammatically indicated at 5 in the drawing.

Figure 3:
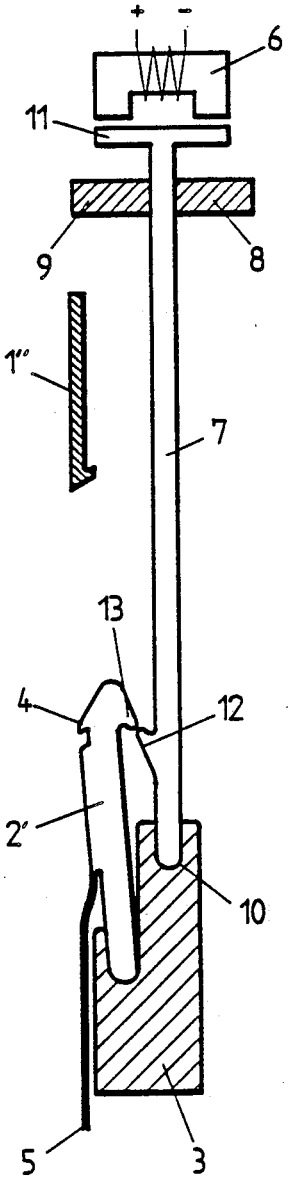
FIG. 3 is a view of the FIG. 1 structure in still another position.

A magnetic means 6 which in the illustrated embodiment is in the form of an electromagnetic device or solenoid is arranged in the drawing above the upper point of reversal of movement of the lift blade 1, being therefore above the position of the lift blade which is indicated at 1" in FIG. 3. It will be seen therefore that the device 6 is arranged on the side of the point of reversal of the movement of the lift blade, which is remote from the associated hook 2. The purpose of the device 6 is to be able to arrest the hook 2 in the non-hooking position shown in FIGS. 1 and 2. For that purpose, provided between the device 6 and the corresponding hook 2 is an elongate control member 7 which is arranged to be movable in the direction of the movement of the lift blade 1, that is to say vertically in the position illustrated in the drawing. The arrangement includes upper guide means 8 and 9 for guiding the control member 7 in its vertical movement while a recess 10 is provided in the bottom member 3 to guide the control member at its lower end. The control member 7 provides a magnet armature portion 11 at the end region of the control member 7, which is towards the device 6 and thus remote from the hook 2. FIGS. 1 and 3 show the position of the arrangement in which the device 6 is not operative and as a result the armature portion 11 is not attracted to the device 6 and the control member 7 has dropped into its lower position, under the effect of its own weight. FIG. 2 on the other hand shows the position of the arrangement in which the armature portion 11 has been attracted by the actuated device 6 and the control member 7 has thus been lifted.

The second end portion of the control member 7, which is thus directed towards the hook 2, has a mechanical arresting means as indicated generally at 12 in the drawing. The arresting means is illustrated in the form of a tapering projection on the control member. The hook 10 in turn carries a co-operating portion indicated at 13 which is adapted to co-operate with the projection 12 on the control member 7, in a manner which will be clearly apparent from FIG. 2.

In the illustrated embodiment, as indicated above, the arresting means 12 is in the form of a tapering projection comprising a recess portion and a raised portion. The co-operating portion on the hook 2 also has a corresponding recess portion and raised portion. The projection 12 and the co-operating portion 13 are of a rounded configuration, and merge into each other in a wave-like manner. It will be clearly apparent from FIG. 2 that the respective recess portions and raised portions co-operate in such a way as to provide for positive interengagement between the projection 12 and the co-operating portion 13.

FIG. 1 shows the above-described structure in a position in which, due to a preceding downwardly directed movement of the lift blade 1, the hook 2 has been pivoted in a clockwise direction against the biasing force applied by the harness system 5, into a non-hooking position in which therefore it cannot be engaged by the lift blade 1. The control member 7 is in a downward position as the electromagnetic device 6 has not been electrically actuated. If, with the arrangement in the position shown in FIG. 1, the device 6 is actuated to attract the armature portion 11 and thus move the control member 7 upwardly from the position shown in FIG. 1 into the position shown in FIG. 2, then the arresting projection 12 and the co-operating portion 13 on the hook 2 come into positive engagement with each other to retain the hook 2 in the non-hooking position.

As a result, when the lift blade 1 performs an upwardly directed lift movement from the position indicated at 1 in FIG. 1 into the position indicated at 1' in FIG. 2, the lift blade cannot engage the hook 2 to entrain it in its upward movement. The hook 2 therefore remains supported on the bottom member 3.

If however, with the arrangement shown in FIG. 1, the device 6 is not actuated to lift the control member 7, thereby to retain the hook 2 in the position illustrated in FIG. 2, then, upon an upwardly directed movement of the lift blade 1 from the position shown in FIG. 1 towards the position shown at 1'' in FIG. 3, the lift blade 1 will engage the hook 2 and thus entrain it upwardly. The hook 2 is biased towards the position in which it can be engaged by the lift blade, due to the biasing force applied to the hook 2 by the harness 5. The hook 2 can thus move upwardly out of the bottom shed position illustrated in the drawings. The lifted position of the hook 2 is not shown.

FIG. 3 shows the lift blade in its upper position at which its direction of movement is reversed. The control member 7 is illustrated in its downward position in which it has not been lifted by actuation of the electromagnetic device 6 and the hook 2 has been pivoted under the effect of the harness 5 into the hooking engagement position 2' in which therefore the hook 2 projects into the path of movement of the lift blade.

It will be seen from the foregoing that, because the magnet means or electromagnetic devices 6 are arranged at the side of the point of reversal of the movement of the lift blade, which is remote from the respective hook 2 associated therewith, the magnet means can be disposed at locations at which more space is available for the installation thereof, than in the bottom shed region of the arrangement. That in turn makes it possible to use larger magnet means which accordingly increase the level of reliability of operation, while also facilitating ease of actuation and control. The fact that more space is available for installing the magnetic means also results in the placement thereof being an easier operation. In regard to the design configuration of the magnet means, the fact that the magnet means are no longer arranged in the bottom shed region means that they no longer have to be dependent on the available space in that area, so that it is possible for example to choose the most appropriate structure for the magnet means, in regard to magnetic leakage thereof. Arranging the control member between the respective magnetic means and the associated hook gives the advantage that the hook does not have to be in the form of an armature member so that that aspect can be disregarded when choosing the material for the hook.

The invention affords a further advantage when it is used in relation to an arrangement comprising first and second hooks which are interconnected at first ends thereof by way of a common pulling connecting member forming a loop having a roller carried therein, in such a way that the first and second hooks are movable alternately between a top shed position and a bottom shed position. In such an arrangement, a control member associated with a respective magnetic means may be used for both of the first and second hooks. In that case, the control member has oppositely disposed mechanical arresting means which each co-operate with a respective one of the first and second hooks. In comparison with an arrangement in which each hook is in the form of or is provided with an armature, the arrangement just outlined above advantageously requires only one armature for each pair of hooks.

Whereas, in the prior arrangement discussed above, the armature member of each hook is pivoted relative to the surface of the magnetic means with which the armature member co-operates, the arrangement in accordance with the present invention provides that the armature member moves linearly towards the corresponding contact surface of the magnetic device 6, which is advantageous in regard to the magnetic attraction force.

It will be appreciated that the above-described embodiment has been set forth solely by way of example and illustration of the present invention and that various modifications may be made therein without thereby departing from the spirit and scope of the present invention.

What is claimed is:

1. A hook control apparatus for a shed forming machine, comprising: lift blades reciprocally movable in opposite directions between opposite points of reversal; hooks adapted to pivot in a bottom shed position between a hooking engagement position in which they are engageable by the lift blades and a non-hooking position in which they are unengageable by the lift blades, each hook having a retaining portion thereon; a hook bottom means for supporting the hooks in said bottom shed position; means for biasing the hooks towards said hooking engagement position; magnet means adapted to arrest the hooks selectively in their non-hooking position, said magnet means spaced away from said points of reversal of movement of the lift blades in a direction extending away and, remote from the hooks; and an elongate control member extended between the magnet means and the respective hooks movable in the direction of the movement of the lift blades, said control member having a first end portion adjacent a respective magnet means and in the form of an armature means and a second end portion adjacent a respective hook and including a mechanical arresting means for retaining the associated hook in the non-hooking position thereof by co-operating with said retaining portion on said hook.

2. Apparatus as set forth in claim wherein said arresting means is of a tapering configuration and wherein said retaining portion on said hook is of a corresponding configuration.

3. Apparatus as set forth in claim 1 wherein said arresting means and said retaining portion on said hook each have a recess means and a projection means.

4. Apparatus as set forth in claim 3 wherein said recess means and said projection means are of a generally rounded configuration and blend into each other in a wave-like configuration.

5. Apparatus as set forth in claim 1 wherein said magnet means comprise respective electromagnetic devices.

* * * * *